United States Patent [19]

Kenyon

[11] 4,158,184

[45] Jun. 12, 1979

[54] ELECTRICAL FILTER NETWORKS

[75] Inventor: Norman D. Kenyon, Ipswich, England

[73] Assignee: Post Office, London, England

[21] Appl. No.: 790,554

[22] Filed: Apr. 25, 1977

[30] Foreign Application Priority Data

Apr. 29, 1976 [GB] United Kingdom ..... 17481/76

[51] Int. Cl.[2] ..... H01P 1/20; H01P 5/18

[52] U.S. Cl. ..... 333/208; 333/109

[58] Field of Search ..... 333/10, 73 R, 73 C, 333/73 S, 73 W

[56] References Cited

U.S. PATENT DOCUMENTS 3,237,134 2/1966 Price ..... 333/73 W

OTHER PUBLICATIONS

*Marconi Rev.* (GB) vol. 36, No. 190 (1973) pp. 160–192, Bodonyi, J., "Channelling Filter for Trunk Waveguide Communication at Millimetric Wavelengths".

*Primary Examiner*—Alfred E. Smith
*Assistant Examiner*—Harry E. Barlow
*Attorney, Agent, or Firm*—Hall & Houghton

[57] ABSTRACT

An electrical filter network particularly suitable for use at microwave frequencies, comprises a main transmission path and a plurality of pairs of secondary paths interconnected by couplers which divide an incoming signal into components on the several paths and recombine the transmitted components to provide an output signal. Conditions are placed on the electrical lengths of the transmission paths; the magnitude of the frequency-independent components of phase change along the paths and the wave amplitudes in the paths.

11 Claims, 8 Drawing Figures

ELECTRICAL FILTER NETWORKS

This invention relates to electrical filter networks and, more especially, to filter networks which are suitable for use at microwave frequencies.

Electrical filters are often used to shape the frequency response of a transmission channel: two common reasons are to limit a transmission frequency band so that it does not interfere with an adjacent transmission frequency band; and to shape a frequency band to minimize intersymbol interference.

Many arrangements have been used as filter networks, including capacitor and inductor networks. However, a property of the filter arrangement that is important is the linearity of the phase/frequency response, and although two-path interference filters have been used at microwave frequencies and have been found to have relatively good phase/frequency responses, they have only a limited range of possible attenuation/frequency characteristics.

According to the invention there is provided a filter network comprising an input port, an output port and, between the ports, a main transmission path and a number of pairs of secondary transmission paths, where each said pair of transmission paths has the same average electrical length as the main transmission path; where the frequency-independent component of phase change along the main transmission path is different from the average frequency-independent component of phase change along each said pair of transmission paths by an integral multiple of $\pi$ radians, said multiple being positive, negative or zero, and where the wave amplitudes in each path of each said pair of secondary transmission paths are the same.

The term "average" in this specification is used to denote the arithmetic mean, and all phases are in radians.

Filter networks constructed in accordance with the invention will now be described by way of example with reference to the accompanying drawings of which:

Figure 1:
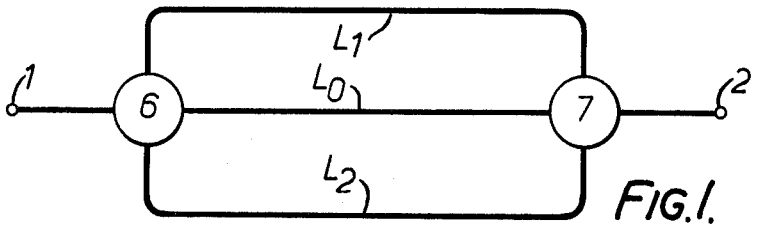
FIG. 1 is a diagrammatic representation of a 3-path network.

In order to provide a better understanding of a network in accordance with the invention it is desirable to consider the theoretical equations governing its behaviour. Referring now to FIG. 1, which is a diagrammatic representation of a 3-path network, there is shown an input port 1 and an output port 2. Said input port 1 is connected to a first device 6 which splits an incoming signal into three components, one along a main transmission path $L_0$ and the others along a pair of secondary transmission paths $L_1$ and $L_2$. Said components are re-combined at a second device 7 and the resultant signal appears at the output port 2.

In this specification, when referring to FIG. 1, the subscript 0, 1 and 2 will be used to indicate variables associated with paths $L_0$, $L_1$ and $L_2$, respectively.

The electrical lengths between the inputs and output ports 1 and 2 along each of the 3 paths are $$L+\lambda_0 x_0,\ L+\lambda_0 x_1 \text{ and } L+\lambda_0 x_2 \tag{1}$$

where $\lambda_0$ is a reference wavelength and defines the center frequency of the filter, and L is an arbitrary length (possibly zero). Said devices 6 and 7 may introduce frequency-independent phase changes along paths passing therethrough, the frequency-independent phase changes along the 3 paths due to both devices having values of:

$$P_0\pi/2,\ P_1\pi/2 \text{ and } P_2\pi/2 \tag{2}$$

where, as so far described, $P_\eta$ is not necessarily integral and may be zero.

The signal amplitudes along each of the 3 paths $L_0$, $L_1$ and $L_2$ will be indicated by $A_0$, $A_1$ and $A_2$.

It is well known that each path will contribute a signal at said output port 2 of $$A_n \exp j\,(2\pi ft - 2\pi(f/fo)x_n - P_n(\pi 2)) \tag{3}$$

when the signal at the input port 1 is $$\exp j\,2\pi ft \tag{4}$$

$f_0$ is the frequency corresponding to $\lambda_0$; f is the frequency of the input sinusodal signal, and t is time. The total output at output port 2 will be given by the sum of expression (3) over the paths $L_0$, $L_1$ and $L_2$.

If the values of the variables for each path meet certain conditions, it can be shown that the resulting network will have a filtering characteristic. The first such condition is that the amplitudes of the signals on the 2 secondary transmission paths $L_1$ and $L_2$ shall be the same.

The second condition is that the main transmission path $L_0$ has the same electrical length as the average electrical length of the secondary transmission paths $L_1$ and $L_2$. Mathematically this can be expressed as $$x_0 = x_1 + x_2/2 \tag{5}$$

The third condition is that the difference between any frequency-independent phase change along the main transmission path $L_0$ and the average of any frequency-independent phase changes along the secondary transmission paths $L_1$ and $L_2$ shall be an integral (positive, negative or zero) multiple of $\pi$. Mathematically this may be expressed as, where n is an integer, $$P_0 - P_1 + P_2/2 = \pi 2n \tag{6}$$

Summing the expressions (3) under these conditions, the output of the network is seen to be $$\exp[j\cdot 2\pi f(t - \frac{x_1 + x_2}{2fo})]\exp(-jP_o\frac{\pi}{2})[A_o + A_1 e^{j\pi n} 2\cos(\pi\frac{f}{fo}(x_2 - x_1) - (P_1 - P_2)\frac{\pi}{4})] \tag{7}$$

It is clear that the output phase decreases linearly with frequency, while a variety of amplitude shaping functions can be obtained by an appropriate choice of $A_1/A_0$, $x_1/x_0$, $P_1$ and $P_2$ or, in other words, by shunting power into different parts of the network. Since shaping takes place in this manner, while presenting the same input impedance, input matching at all frequencies is provided.

An important feature of the expression (7) is that the term $$A_o + A_1 \exp j\pi n\, 2\cos\left(\pi \frac{f}{f_o}(x_2 - x_1) - (P_1 - P_2)\frac{\pi}{4}\right) \quad (8)$$

depends only on the parameters, respectively, of the main transmission path $L_0$ and the pair of secondary transmission paths $L_1$ and $L_2$. It is thus possible to determine the results of a similar analysis of any network with an odd number of paths relatively easily. More particularly, the expression $$A_s \exp j\pi n\, 2\cos\left(\pi \frac{f}{f_o}(x_{s2} - x_{s1}) - (P_{s1} - P_{s2})\frac{\pi}{4}\right) \quad (9)$$

completely represents the contribution of a pair of side paths in a multipath network, and any pair of side paths which independently meets the conditions stated earlier in this specification will produce such an independent term to be added to the amplitude equation of the output of the network. In expression (9) $A_s$ is the amplitude of the signal on each path of the pair of secondary transmission paths; $x_{s1}$ and $x_{s2}$ are the electrical lengths respectively of each one of the secondary transmission paths of the pair, and $P_{s1}$ and $P_{s2}$ are the frequency-independent phase changes respectively along the said secondary transmission paths.

In the special case where the path difference in electrical length $x_{s1} - x_{s2}$ for each pair of secondary paths is an integral multiple of the same small electrical length (d), the expression (9) reduces to the form $$B_n \cos\left(n \frac{\pi d}{f_o} f + \phi_n\right) \quad (10)$$

which is the general term in a Fourier series. In this special case, accordingly, a periodic amplitude/frequency function is obtained.

In the further special case of a three-path network (a main transmission path and one pair of secondary transmission paths) a sinusoidally varying function is obtained provided that $A_c \geqq 2A_1$.

Some examples of networks constructed according to the stated conditions will now be described, and the theoretical amplitude/frequency responses will be shown.

Each of the networks described employs four-port couplers to divide and combine signals (equally or unequally, as appropriate). These devices are well known within the art and their construction need not be described here. As a convention, each coupler is described as having a first and a second input and a first and a second output, and, in each case, the paths from the first input to the first output and from the second input to the second output are direct, with no phase change. So far as the paths from the first input to the second output and from the second input to the first output are concerned there may be either (i) no phase change on either path or (ii) a frequency independent phase change of $\pi/2$ on both paths. Couplers of type (i) will be referred to as "zero phase change couplers" and those of type (ii) will be referred to as "$\pi/2$ phase change couplers."

Figure 2:
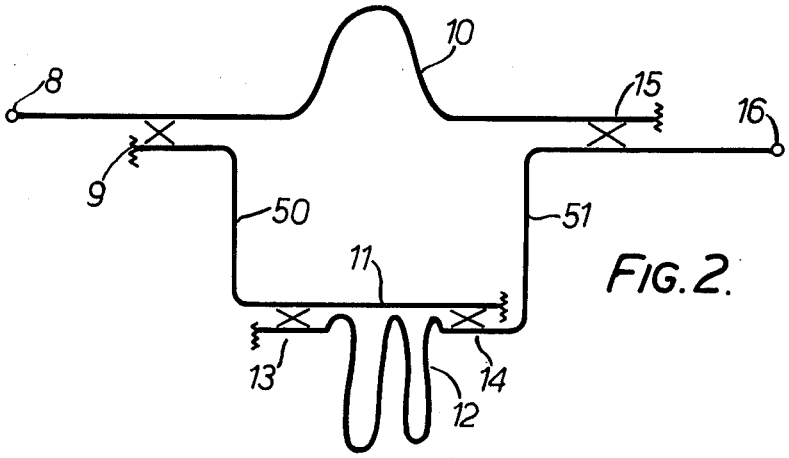
FIGS. 2, 3 and 4 are different examples of 3-path networks.

Referring now to FIG. 2, there is shown a particular example of a 3-path filter. There is provided an input port 8 and an output port 16. There are further provided a zero phase change coupler 9, and $\pi/2$ phase change couplers 13, 14 and 15. The input port 8 is connected to the coupler 9 and the first output of the coupler 9 is connected by a path 10 to the first input of the coupler 15. The second output from the coupler 9 is connected by a path 50 to the first input of the coupler 13. A path 11 connects the first output of the coupler 13 to the first input of the coupler 14 and a path 12 connects the second output of the coupler 13 to the second input of the coupler 14. The second input of the coupler 13 is terminated in a matching impedance and so also is the first output of the coupler 14. The second output of the coupler 14 is connected to the second input of the coupler 15 by path 51. The output port 16 of the filter is connected to the second output of the coupler 15 and the first output of the coupler 15 is terminated in a matching impedance. In this case the couplers 9 and 13 to 15 are each arranged so that the signal at any one input is equally divided between the 2 outputs.

Figure 6:
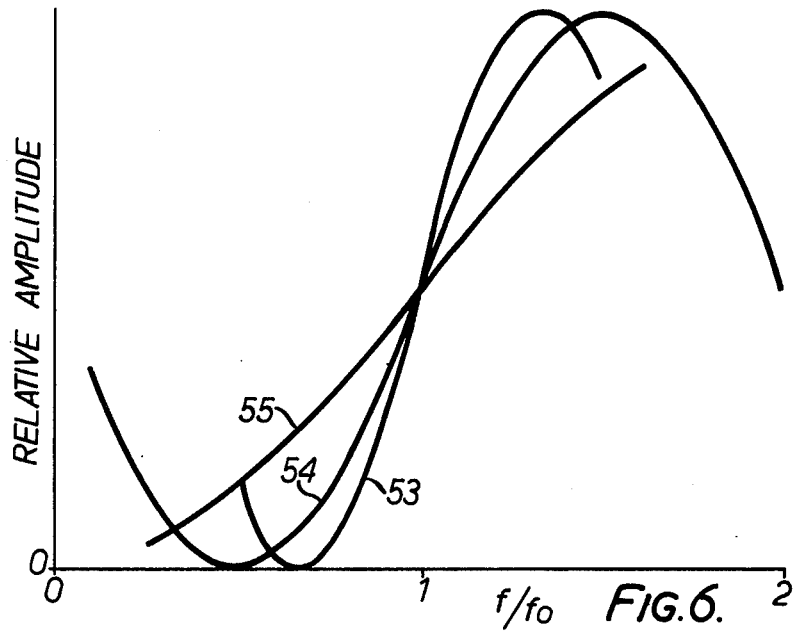
FIGS. 6, 7 and 8 are theoretical frequency/attenuation responses of various networks.

It is therefore apparent that there are 3 routes through the network of FIG. 2 from the input port 8 to the output port 16, which routes may be conveniently identified as being via paths 10, 11 and 12. The route via path 10 corresponds to the main transmission path of the theoretical discussion above and, along this route, there is one frequency-independent phase change of $\pi/2$ (this being at the coupler 15). The routes via paths 11 and 12 correspond to the pair of secondary transmission paths of the theoretical discussion and, along each of these routes, there is also one frequency-independent phase change of $\pi/2$ (these being at the coupler 14 via path 11 and at the coupler 13 via path 12). It will also be apparent that the amplitudes of the signals reaching the output 16 via paths 11 and 12 are each equal to one half of that reaching the output via path 10. The route via path 10 is constructed so that it has a total electrical length, from the input port 8 to the output port 16, of $L+2\lambda_0$ where L is any arbitrary length (possibly zero). The route via path 11 is constructed to have an electrical length between the said input port 8 and the output port 16 of $L+5\lambda_O/4$ and the route via path 12 is constructed to have an electrical length between said input port 8 and said output port 16 of $L+11\lambda_O/4$. It will be apparent from the parameter of the network shown in FIG. 2 that the conditions stated earlier in this specification apply to this network and therefore from the mathematical analysis given earlier it would be expected to behave as a linear phase filter network. Curve 53 in FIG. 6 shows the theoretical response to be expected from the network of FIG. 2.

Figure 3:
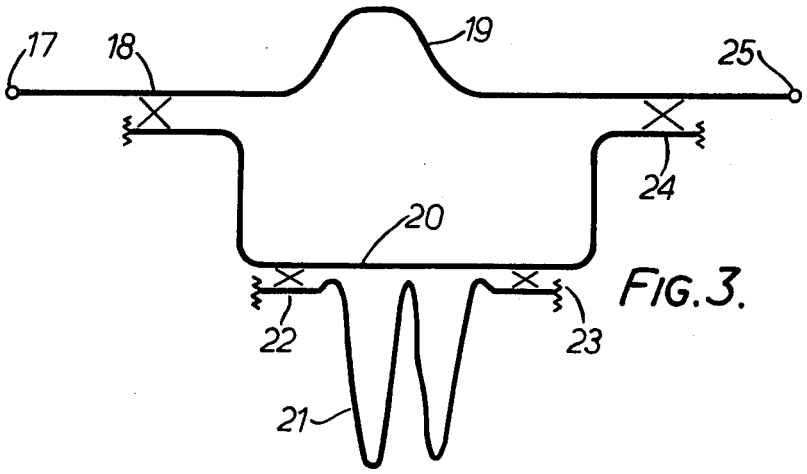

FIG. 3 shows a further possible 3-path network, which again uses only couplers that divide equally (or combine) the signal(s) on the input(s) of the couplers. Referring now to FIG. 3, there is provided an input port 17 and an output port 25. There are further provided a zero phase change coupler 18 and 90/2 phase change couplers 22, 23 and 24. The input port 17 is connected to the coupler 18 so that a signal from the input is divided equally into 2 parts. One output of said coupler 18 is connected by a path 19 to the first input of the coupler 24. The other output of the coupler 18 is connected to the first input of the coupler 22. The second output of the coupler 22 is connected to the second input of the coupler 23 by a path 21 and the first output of the coupler 22 is connected by a path 20 to the first input of the coupler 23. The second input of the coupler 22 and the second output of the coupler 23 are terminated in matching impedances. The first output of the coupler 23 is connected to the second input of the coupler 24. The second output of the coupler 24 is terminated in a matching impedance and the output port 25 is connected to the first output of the coupler 24.

It will be apparent that there are 3 routes through the network of FIG. 3 and these are via paths 19 (the main transmission path) 20 and 21 (the secondary transmission paths). The routes are arranged to have electrical lengths between the input port 17 and the output port 24 of, respectively $L+2\lambda_0$, $L+3\lambda_0/2$, and $L+5\lambda_0/2$. It will again be apparent from a consideration of the parameters of the network of FIG. 3 that the mathematical analysis given in this specification will apply and that the network will have a filtering characteristic. The theoretical response of the network in FIG. 3 is shown by Curve 54 in FIG. 6.

Figure 4:
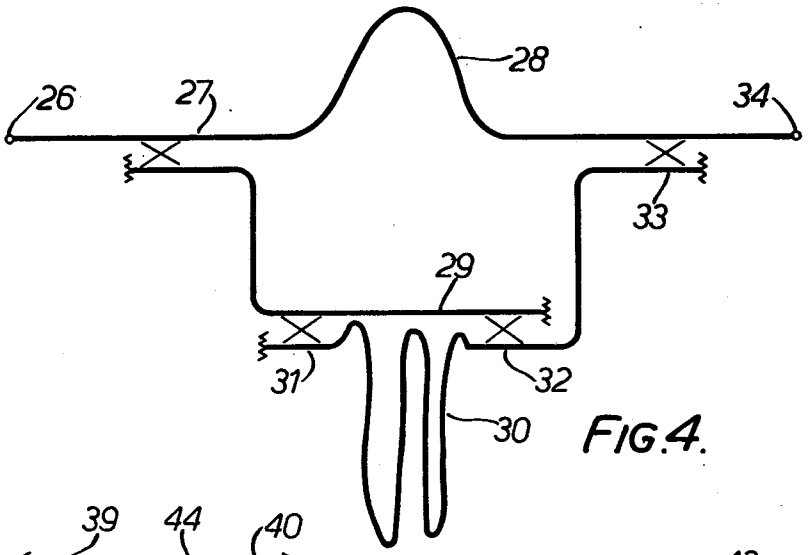

A simple modification of the network of FIG. 2 is shown in FIG. 4, and it will be apparent by inspection of the figures that the output port of the network (numbered 34 in FIG. 4) has been taken from the second output of the coupler 33 rather than the first output of the corresponding coupler 15 as in FIG. 2. The modification has the effect of changing the number of frequency independent phase changes along the various routes through the network and, in addition, the lengths of the routes differ from those in FIG. 2. More particularly, the route via path 28 (the main transmission path) has a length of $L+2\lambda_0$ while the routes via paths 29 and 30 (the secondary transmission on paths) have lengthen of $L+7\lambda_0/4$ and $L+9\lambda_0/4$ respectively. Again, a consideration of the parameters of the modified network shown in FIG. 4 shows that the mathematical analysis given above applies, and the filter response of the said network shown in FIG. 4 is shown in FIG. 6 as curve 55.

Figure 5:
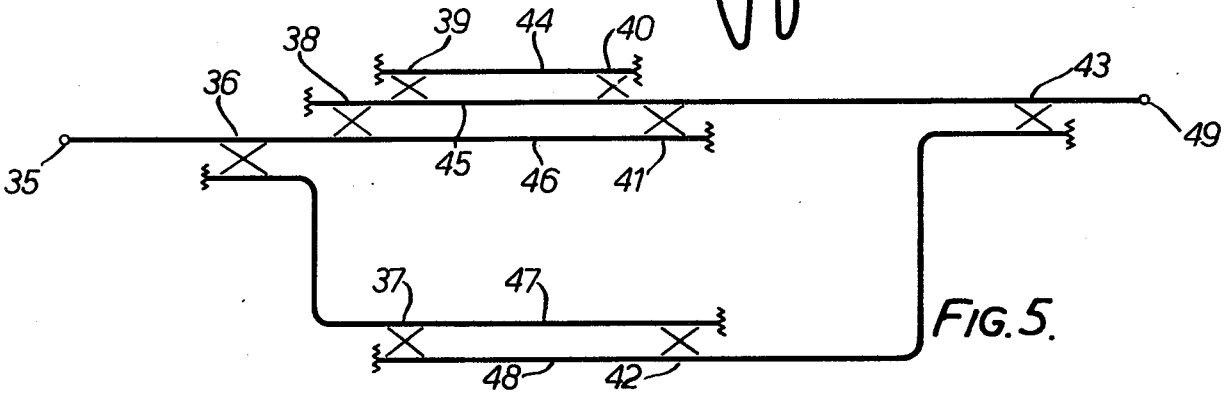
FIG. 5 is an example of a 5-path network.

Referring now to FIG. 5, there is shown a 5-path network with an input port 35 and an output port 49. There are further provided couplers 36 to 43, of which couplers 39 and 40 are zero phase change couplers, the remainder being $\pi/2$ phase change couplers. Input port 35 is connected to the first input of the coupler 36. The second input of the coupler 36 is terminated in a matching impedance. The first output of the coupler 36 is connected to the second input of the coupler 38 and the second output of the coupler 36 is connected to the first input of the coupler 37. The second input of the coupler 37 and the first input of the coupler 38 are terminated in respective matching impedances. The second output of the coupler 38 is connected, by a path 46, to the second input of the coupler 41 and the first output of the coupler 38 is connected to the coupler 39 which has outputs to paths 44, 45. The signals from paths 44 and 45 are re-combined by the coupler 40 and the re-combined signal is passed to the first input of the coupler 41. The first output of the coupler 37 is connected by a path 47 to the first input of the coupler 42 and the second output of the coupler 37 is connected by a path 48 to the second input of the coupler 42. The coupler 43 has its first input connected to the first output of the coupler 41, and the second input of the coupler 43 is connected to the second output of the coupler 42. The first output of the coupler 42, the second output of the coupler 41 and the second output of the coupler 43 are each terminated in separate matching impedances. The output port 49 is connected to the first output of the fifth coupler 43.

Figure 7:
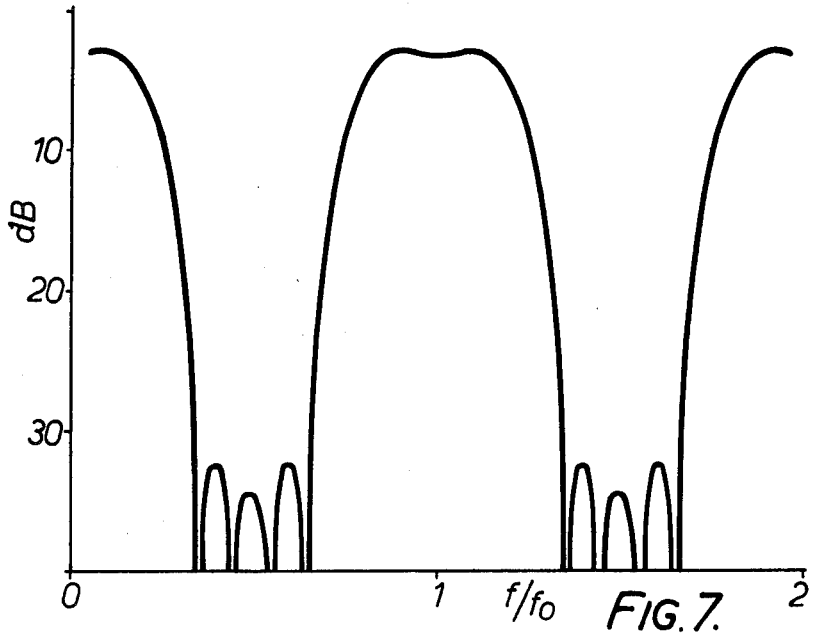

It will be apparent that there are 5 routes through the network from the input port 35 to the output port 49: these are via paths 44, 45, 46, 47 and 48, and the lengths of these routes between the input port 35 and the output port 49 are made respectively $L+6\lambda_0$, $L+4\lambda_0$, $L+5\lambda_0$, $L+8\lambda_0$ and $L+2\lambda_0$. The route via path 46 corresponds to the main transmission path of the theoretical discussion set out earlier and there is one frequency-independent phase change of $\pi/2$ along this route. The routes via paths 44 and 45 constitute a first pair of secondary transmission paths and along each of these routes there is one frequency-independent phase change of $\pi/2$. The routes via paths 47 and 48 constitute a second pair of secondary transmission paths and along each of these routes there are three frequency-independent phase changes of $\pi/2$. In the network shown in FIG. 5, the couplers 37, 39, 40, 42 divide (or combine) the input signal(s) equally but the remainder do not, it being necessary to adjust the couplers to give the correct amplitudes along each path. The relative amplitudes of the signals reaching the output via each of the 5 paths 44 to 48 are, respectively, 0.225, 0.225, 0.37, 0.05 and 0.05. These amplitudes can be achieved by the precise design of the couplers. With the parameters given, the mathematical analysis given earlier in this specification again applies, and the theoretical response of the network is shown in FIG. 7.

Figure 8:
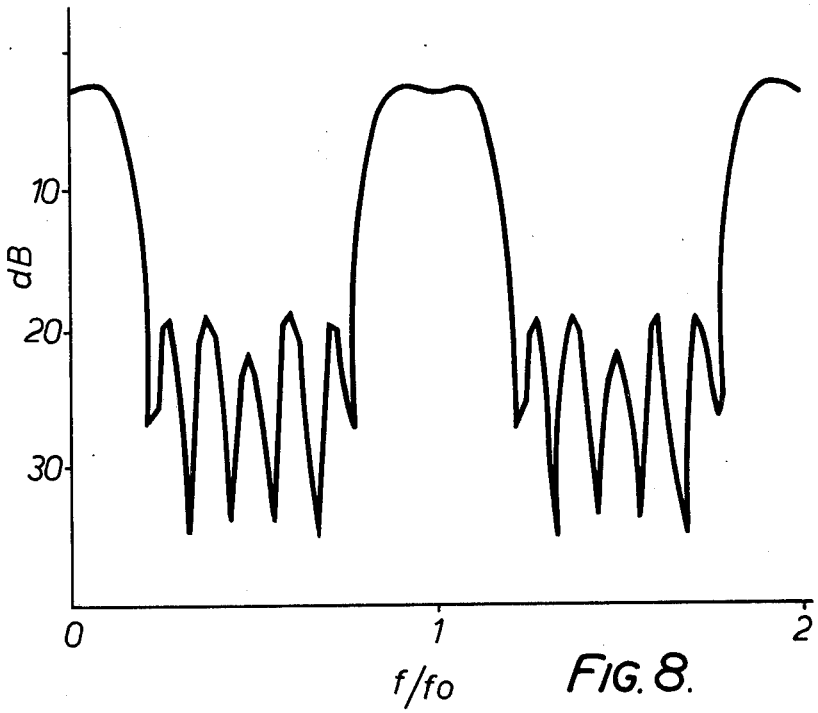

As an example of the response that may be achieved with a more complex network, the curve in FIG. 8 shows the response of a 7-path network, which has not been illustrated. The parameters of each of the 7 paths are given below, the figures on each line representing the parameters applying to one path through the network, the first figure indicating the relative length, the second figure indicating the number of frequency-independent phase changes of $\pi/2$ which are encountered on that path and the third figure indicating the relative output amplitude of the signal along that path.

| relative length of path × (actual length = L + × $L_o$) | number of $\pi/2$ phase changes | relative amplitude of signal |
|---|---|---|
| 5 | 2 | 0.225 |
| 6 | 2 | 0.20 |
| 4 | 2 | 0.20 |
| 7 | 2 | 0.10 |
| 3 | 2 | 0.10 |
| 9 | 4 | 0.0685 |
| 1 | 4 | 0.0685 |

It will be seen from the curve in FIG. 8 that the 7-path network whose parameters are given above has a filter response approximating to a square wave. It will however be noted that the relative amplitudes of the signals along the various paths through the network are not precisely those to be expected from examination of the Fourier series of a square wave. This is because, in practice, couplers are rather expensive items to produce, and therefore it is desirable to use as few paths (and hence, couplers) as is possible in order to meet the demanded performance. When only a few terms of the Fourier transform corresponding to pairs of side paths in the network, are used, it is usually possible to obtain a better approximation to a square wave by modifying the amplitudes of the terms used from the theoretically correct values. In this case the approximation has been done by trial and error, and this would be the method which would be used in any particular case.

Finally, it should be mentioned that the networks described above employ couplers to divide and combine signals since these are well known and commonly available components. It is, however, possible for any other component having a similar performance specification (or indeed a combination of components) to be used instead of a coupler. The term "coupler" should, accordingly, be interpreted as including not only those devices having this particular designation in the art but also any other devices having similar performance specifications.

I claim:

1. A filter network comprising an input port, an output port and, between the input and output ports, a main transmission path and at least one pair of secondary transmission paths such that:

(i) in each pair of secondary paths the electrical lengths of the paths are unequal while their average is the same as the electrical length of the main path;

(ii) the average frequency-independent component of phase change undergone by a signal transmitted along each pair of secondary paths differs by an integral multiple of $\pi$ radians from that undergone by a signal transmitted along the main path, where the integral multiple may be positive, negative or zero, and (iii) for each pair of secondary paths, a transmitted signal has the same wave amplitude in each path.

2. A network as claimed in claim 1, including a signal-dividing arrangement connected to receive a signal from the input port and to divide the signal into components on the main and secondary paths, and a signal-combining arrangement connected to receive signal components from the main and secondary paths and to combine the components to provide an output signal at the output port.

3. A network as claimed in claim 2, in which at least one of the said arrangements is operable to introduce a frequency-independent component of phase change into at least one of the signal components.

4. A network as claimed in claim 2, in which the signal-dividing arrangement comprises a plurality of couplers each connected to divide an incoming signal into two components.

5. A network as claimed in claim 2, in which the signal-combining arrangement comprises a plurality of couplers each connected to combine two incoming signal components to provide an output signal.

6. A network as claimed in claim 2, in which the signal-dividing and signal-combining arrangements comprise a plurality of couplers each of which introduces no frequency-independent component of phase change.

7. A network as claimed in claim 2, in which the signal-dividing and signal-combining arrangements comprise a plurality of couplers at least one of which introduces a frequency-independent component of phase change of $\pi/2$.

8. A network as claimed in claim 2, in which the signal-dividing and signal-combining arrangements comprise a plurality of couplers each of which has a first and a second input and a first and a second output, and paths from each input to both outputs, the paths between the first input and the first output and between the second input and the second output introducing no frequency independent component of phase change.

9. A network as claimed in claim 8, in which the coupler is operable to divide an incoming signal on either of the inputs equally between the two outputs.

10. A network as claimed in claim 1, in which, for each pair of secondary paths, the difference in the electrical lengths of the paths is an integral multiple of the same small electrical length.

11. A network as claimed in claim 10, which has one pair only of secondary paths such that a transmitted signal has a wave amplitude in the main path which is very substantially greater than twice the wave amplitude in the secondary paths, whereby the network provides an amplitude/frequency function which varies sinusoidally.

* * * * *